United States Patent [19]

Afanasjuk et al.

[11] 4,165,781

[45] Aug. 28, 1979

[54] FLASKLESS STACK MOLDING MACHINE

[76] Inventors: Ivan N. Afanasjuk, ulitsa Angarskaya, 12, korpus 2, kv. 9; Viktor V. Grabovsky, ulitsa Fabrichnaya, 12, kv. 19; July M. Kliot, ulitsa Landera, 8, kv. 81; Larisa M. Lebedeva, ulitsa Angarskaya, 26, korpus 2, kv. 51; Anatoly I. Khodin, ulitsa Tashkentskaya, 26, korpus 9, kv. 9, all of Minsk, U.S.S.R.

[21] Appl. No.: 871,022

[22] Filed: Jan. 20, 1978

[51] Int. Cl.[2] ..... B22C 11/10

[52] U.S. Cl. ..... 164/181; 164/213

[58] Field of Search ..... 164/168, 180, 181, 187, 164/213, 225, 191

[56] References Cited

U.S. PATENT DOCUMENTS 3,974,872 8/1976 Buhrer ..... 164/187 X

*Primary Examiner*—Robert D. Baldwin

*Attorney, Agent, or Firm*—Lackenbach, Lilling & Siegel

[57] ABSTRACT

A flaskless stack molding machine comprises a frame on which along the production process line a flask molding means and a means for separating flasks from the molds and assembling the molds into stacks are sequentially mounted. The means for separating the flasks from the molds and assembling them into stacks is provided with a stack-assembling bottom carriage mounted for vertical movement on guides attached to the frame and a bottom plate secured over the bottom carriage. The frame also supports a mechanism for transporting the flasks freely placed thereon. The means for separating the flasks from the molds and assembling them into stacks incorporates a top carriage for separating the flasks from the molds, which is for vertical movement on the guides secured on the frame and is arranged between the bottom carriage and the bottom plate. A drive means for vertical motion of the top carriage is secured on the frame and a drive means for the bottom carriage is rigidly affixed on the top carriage.

2 Claims, 9 Drawing Figures

FLASKLESS STACK MOLDING MACHINE

BACKGROUND OF THE INVENTION

1. Field of the Invention

The invention relates to foundry production and, in particular, to flaskless stack molding machines.

The invention may find a most advantageous use in the manufacture of castings in expendable sand molds which are assembled in stacks (vertical stack moldings). Such molds are used, e.g., for obtaining castings of piston rings, valve seats and similar parts.

2. Description of the Prior Art

There are known in the art single- and multi-station apparatus for stack molding, the molds produced therein being assembled manually into stacks.

A single-station stack molding apparatus includes a pneumatic piston drive means arranged vertically. The top part of the piston is formed with a horizontal table on which a pattern plate with patterns of castings to be manufactured is secured. A spring-loaded sand frame encompasses the pattern plate. A squeezer board, which in its original position is located sideways with respect to the pattern plate, is hinged to the drive housing. In the working position the squeezer board is placed over the pattern plate.

At the beginning of a cycle an empty flask is set manually on the sand frame and sand is supplied with the aid of a device which is not part of the apparatus. The sand is levelled off manually in the flask and the squeezer board is brought into a working position. The sand is then packed in the flask by means of the aforesaid piston drive means, the pattern plate being separated from the mold during the back stroke of the piston and a mold being obtained with a cavity corresponding to the casting to be manufactured. The squeezer board is then pushed into its original position, while the flask with the mold is lifted manually off the apparatus and placed in a stack.

The main disadvantage of such apparatus is the large amount of manual labor for manufacturing and stacking the molds and a correspondingly low efficiency.

In multi-station apparatus the manufacture of the molds in the flasks is automated. A prior art three-station apparatus includes a housing in which a hydraulic piston drive means is arranged. A rod of the drive means supports a table with a pattern plate and a sand frame. A crosspiece arranged in the top part of the apparatus is connected to the housing by means of two vertical columns. The crosspiece supports guides which receive a carriage horizontally slidable therein. The carriage accommodates on its underside a squeezer board and, inside, a piston drive means for producing a central orifice in the mold. The carriage is connected, on one side, to the piston drive means for sliding it along the guides and, on the other side, to a chute for feeding molding sand and a sand levelling roll rotatable in bearings. The carriage includes a motor for rotating the levelling roll. In the original position, the carriage is offset with respect to the pattern plate, and in the working position it is located over the pattern plate. A metering device which is a vessel with a gate in the bottom is arranged over the chute when the carriage is in the original position. A vibrating feeder connected to the in-shop sand storage bin (not part of the apparatus) enters the metering device from above. One of the columns supports an indexable table connected to a drive means for indexing through 120°. The table is provided with three working positions along the circumference. Two horizontal planks between which a flask may be installed are attached to the table in each of said working positions. The flasks are fitted with lugs which enter slots in the planks and by which the flasks rest upon the planks and are locked in each working position.

In the first position, the flask is placed manually upon the planks of the table and the table is indexed to move the flask into a second position where a piston drive means with a pattern plate is located. The vibrating feeder is switched on and the metering device is supplied with a predetermined amount of molding sand. The gate is opened and sand is charged into the flask along the chute. The carriage is moved into the working position, the chute distributing sand evenly throughout the surface area of the flask, while the rotating levelling roll levels off and slightly packs the sand from above. Next, sand is packed in the flask with the aid of the pattern plate actuated by the piston drive means and a central orifice is produced in the mold with the aid of a piston drive means for making the orifice. When the drive means rod returns to its original position, the pattern plate backs away from the mold. The flask with the mold is next moved to the third position, removed manually from the apparatus and stacked. The three-station apparatus is highly efficient, but the physical exertion required of the operator is very severe.

There is also known an apparatus wherein the manufacture of molds in flasks, the separation of the flasks from the molds and the assembly of the molds into stacks are performed automatically.

This apparatus comprises bottom and top frames interconnected by columns. Between the frames a four-station table, connected to a drive means which ensures its shuttle rotation through 90° about a vertical axis is mounted. The working positions on the table are arranged at equal distances along the circumference. The top frame supports a central piston drive means intended to lift and lower the table. In each position of the table a flask is rigidly secured. Inside each flask a squeezer board connected to a guide vertical rod is arranged. The squeezer board with the rod is slidable vertically. A spring retains the board in its top position. The frame accommodates equidistantly arranged on its circumference two identical means for flask molding and two identical means for separating the flasks from the molds and stacking them, these means each being set diametrically opposite the other. When the table is locked in position, the axes of the flasks coincide with the axes of said means.

The apparatus for flask molding includes a pedestal with a pattern plate, a squeezer piston drive means and a core-blowing device. The pedestal is mounted on the bottom frame in such a manner that the level of the pattern plates is below that of the flasks when the table rotates. The pedestal houses a piston drive means for producing a central orifice in the molds. The squeezer piston drive means is attached to the top frame and located co-axially with the squeezer board rod. The mobile part of the drive means faces downwards. The core-blowing device intended for transporting molding sand to the flask with the aid of compressed air is arranged outside the table with the flasks and is hinged to the top frame and the piston drive means which is also connected to the top frame and intended to force the core-blowing device against the flask. The nozzle of the core-blowing device faces the flask. The core-blowing device is surmounted by a means for charging molding sand (not part of the apparatus). The means for separating flasks from molds and stacking them comprises a piston drive means for pushing the molds out of the flasks and a vertically slidable carriage for assembling the stacks. The piston drive means is placed on the top frame and its rod is oriented downwards and arranged co-axially with the rod of the squeezer plate. The carriage is located underneath the flask and connected to two vertical mobile gear racks. The gear racks mesh with a gear shaft which supports a normally closed brake and a cam drum of a profile of a variable radius whose value increases according to an Archimedean spiral. The cam drum is connected by a flexible means to the rod and the piston of an equalizing cylinder in which a constant pressure is maintained.

The carriage is provided with a pan whereon molds are stacked and transported. The cam drum is so positioned on the shaft that, when the carriage is in its topmost position and an initial mold is placed on the pan, the arm of the flexible means is that of a least cam radius. The carriage is connected to the piston drive means rod for moving it in the top position.

The operation of the apparatus is begun by lowering the indexable table until the flasks bear against the pattern plates. Two core-blowing devices are simultaneously forced against the flasks, the ducts in the nozzles and in the flasks for supplying the molding sand then aligning themselves one opposite the other. When making the initial molds for each stack, the rods of the drive means for producing the central orifices in the molds are left in the bottom position and the orifice is not made in the initial molds. When subsequent molds are manufactured, the rods of said drive means rise as far as they will go against the squeezer boards. The flasks are then filled with sand with the aid of the core-blowing devices, whereupon the mobile parts of the squeezer board drive means act upon the rods of the squeezer boards to lower them and to pack the sand in the flasks. The squeezer board drive means and the core-blowing devices are then returned to their original positions. The squeezer boards return to original positions under the action of the springs. The table is next lifted with the aid of the central drive means and then indexed through 90°. Two flasks with molds are thus placed co-axially with the means for assembling the stacks and two empty flasks are co-axially placed with the means for manufacturing the molds. The table is lowered again, the initial molds in the flasks approaching the pans for assembling the stacks, but not coming in contact with them, whereas the subsequent molds approach, but fail to contact the stacks. The rods carrying the squeezer boards are lowered with the aid of the drive means for pushing the molds out of the flasks, said squeezer boards forcing the molds out of the flasks. When lowered, each mold contacts the stack, exerts a pressure upon it and forces the stack with the carriage to move downwards. Then the drive means for pushing the molds out of the flasks and the squeezer boards return to their original positions, while the carriages with the stacks remain stationary. After a specified number of molds is stacked on the pans, they are removed from the apparatus and the empty ones are set in their place. A piston drive means then lifts each carriage with the pan in the top position, said drive means then being switched off.

A shortcoming of the aforesaid apparatus is that the edges of the molds are liable to damage, thus causing discards of the castings because the carriage with the pan and the stack it supports tend to move when a mold is being pushed out of a flask. The mold moves in the process in a direction determined by the position of the flask and the flask moves in the direction of motion of the carriage. A lack of parallelism in the motions of the mold and of the stack cause a horizontal offsetting of the stack with respect to the mold when they contact one another. This results in damage to the mold edges and discards of the castings. Practically, the lack of parallelism in said motions is due to unavoidable errors in the manufacture of the apparatus and to wear and misalignments of the mobile elements thereof.

SUMMARY OF THE INVENTION

It is therefore an object of the invention to eliminate the above disadvantages inherent in flaskless stack molding apparatus.

The invention has as an aim simplification of such apparatus.

Still another object of the invention is to improve the reliability of the apparatus.

The above and other objects of the invention are attained by a flaskless stack molding machine having sequentially arranged on a frame a means for flask molding and a means for separating flasks from molds and stacking means for assembling the molds into stacks. The machine has a bottom carriage for stacking the molds mounted for vertical motion on guides of the frame with an independent drive means for its vertical motion, a bottom plate secured over the bottom carriage for assembling stacks, and a mechanism for transporting flasks from one means to another placed on said machine. According to the invention, the means for separating the flasks from the molds and assembling them into stacks is provided with a top carriage for separating the flasks from the molds mounted on the vertical guides of the frame between the bottom carriage for assembling the stacks and the bottom plate, the top carriage being connected to an independent drive means attached to the frame and accommodating an independent drive means for actuating the bottom carriage.

Such constructional arrangement of the flaskless stack molding machine eliminates misalignment of the molds in the stacks during their assembly and thus minimizes discards of the castings.

It is expedient to use as the drive means to actuate the bottom carriage for the stacks in the removable flask stack molding machine a power hydraulic cylinder in which the mobile link is connected to the bottom carriage and the fixed link is mounted on the top carriage.

BRIEF DESCRIPTION OF THE DRAWINGS

These and other objects and features of the invention become readily apparent from one embodiment thereof which will now be described by way of example with reference to the accompanying drawings, in which.

DESCRIPTION OF THE PREFERRED EMBODIMENT

Figure 2:
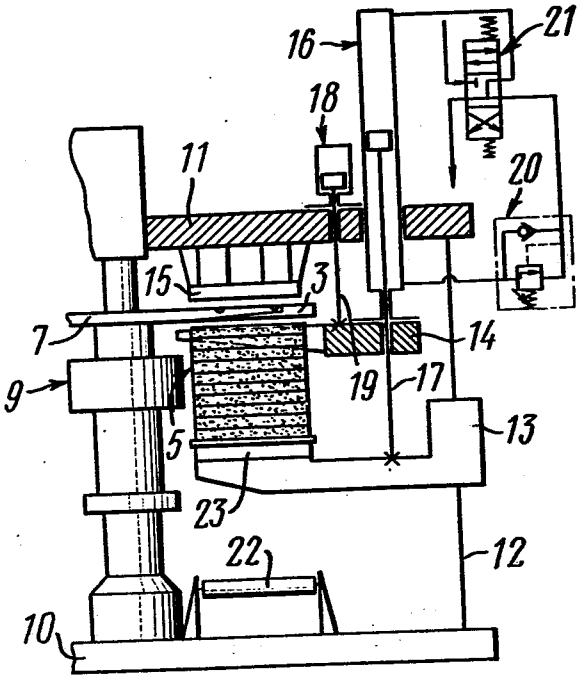
FIG. 2 is a front or elevational view of a machine for flaskless stack molding and a gearing diagram of the means for separating the flasks from the molds and assembling them into stacks.

A flaskless stack molding machine comprises, according to the invention, a manufacturing means 1 (FIG. 1) for manufacturing molds 2 in flasks 3, a separating and stacking means 4 for separating the flasks 3 from the molds 2 and assembling them into stacks 5 (FIG. 2), and a transporting means 6 (FIG. 1) for transporting the flasks 3. The means 6 for transporting the flasks 3 is formed with a three-station indexable table 7, each station of which has two planks 8 for locking the flasks 3. The table 7 is connected to a drive means 9 (FIG. 2) for intermittent counterclockwise indexing through 120°. The first station of the table 7 (FIG. 1) coincides with the means 1 for manufacturing the molds 2 in the flasks 3, the second station is for inspecting the molds 2 at regular intervals of time to check their quality and the third station coincides with the means 4 for separating the flasks 3 from the molds 2 and stacking them.

The means 1 for flask molding may be formed similarly to prior art means for the same applications and is not specified in detail in the present description.

Figure 4:
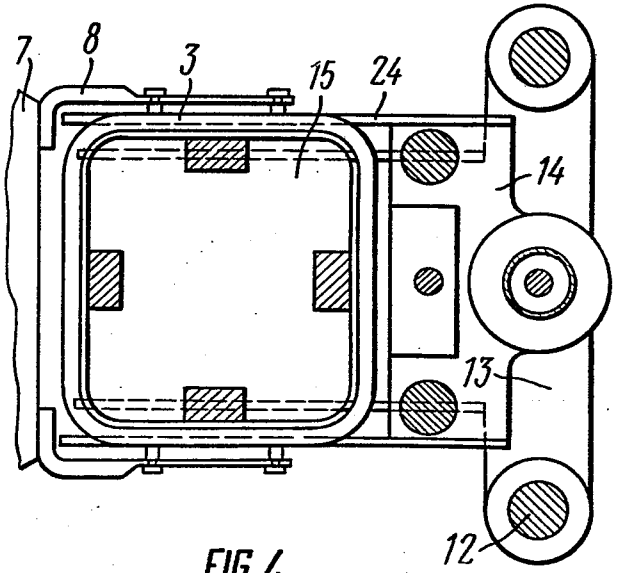
FIG. 4 is a partial cross-sectional view taken along the line IV—IV of FIG. 3.

The means 4 for separating the flasks from the molds and stacking them comprises a frame 10 (FIG. 2), a crosspiece 11, guides 12 (FIGS. 2, 3, 4), a bottom carriage 13, a top carriage 14 and a bottom plate 15. The frame 10 and the crosspiece 11 (FIGS. 2, 3) are interconnected by the guides 12, which include two columns along which the bottom carriage 13 can move.

The means 4 for separating the flasks 3 form the molds 2 and stacking them also comprises a power hydraulic cylinder 16 (FIG. 2) mounted on the top carriage 14. A rod 17 of said hydraulic cylinder 16 is connected to the bottom carriage 13. The crosspiece 11 also supports a piston drive means 18 whose rod 19 is connected to the top carriage 14. The means 4 for separating the flasks 3 from the molds 2 and stacking them incorporates a pressure slide valve 20 with a no-return valve and a reversible slide valve 21 of a known design. The slide valve 20 is mounted on a conduit connecting the slide valve 21 and the rod cavity of the power hydraulic cylinder 16. The slide valve 21 is connected to a hydraulic pump and a hydraulic tank (not shown) of a known design which are not part of the machine in hand. The means 4 also includes a roller table 22 mounted on the frame 10 and interchangeable pans 23 on which the stacks 5 are assembled. During the assembly of the stack 5, the pan 23 is placed on the bottom carriage 13. The pan 23 and the bottom plate 15 are arranged on the same vertical axis with the flask 3 mounted on the indexable table 7.

The bottom plate 15 is located over the flask 3, the top carriage 14 is underneath the flask 3, and the bottom carriage 13 with the pan 23 is underneath the top carriage 14. There are planks 24 (FIG. 4) attached to the top carriage 14 between the planks 8 of the indexable table 7 and the stack whose dimesnions match those of the opening of the flask 3.

The dimensions of the bottom plate 15 are smaller than those of the opening of the flask 3.

In the original position, all the flasks 3 are empty, the pan 23 (FIG. 3) is mounted on the roller table 22, and the bottom carriage 13 is in a position below the roller table 22. The top carriage 14 is in the original position.

Figure 3:
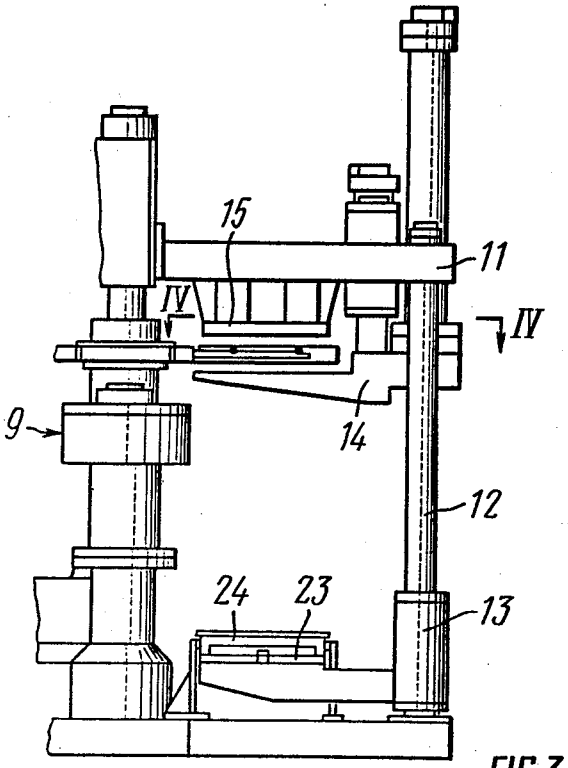
FIG. 3 is a side, elevational view of a flaskless stack molding machine in the original position.
Figure 5:
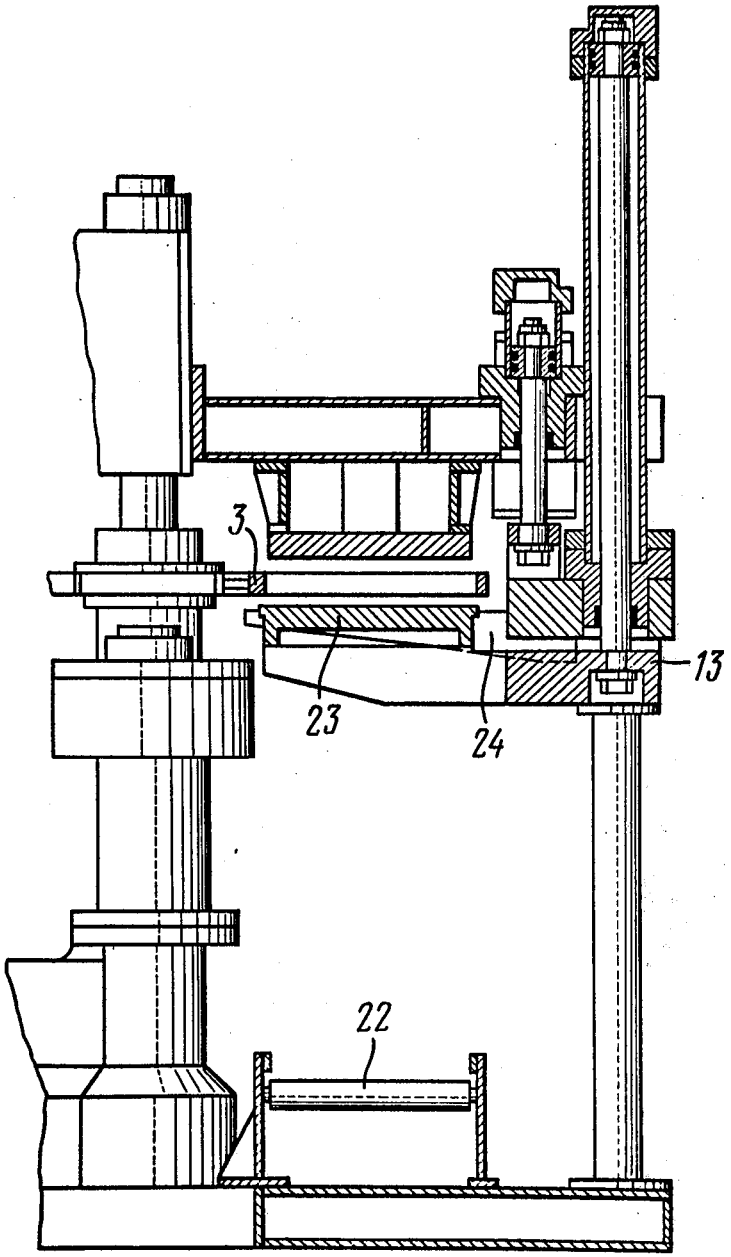
FIG. 5 is a partial cross-sectional view taken along the line V—V of FIG. 1.

When the machine is prepared for operation, the bottom carriage 13 is lifted to the top position (as shown on FIG. 5) by the hydraulic cylinder 16 (FIG. 3) and the slide valve 21. The pan 23 is lifted off the roller table 22 and placed upon the bottom carriage 13 which lifts it above the level of the planks 24, but below that of the flask 3, the hydraulic cylinder 16 then being connected to the hydraulic tank (not shown on the drawing) by means of the slide valve 21 (FIG. 2).

Figure 1:
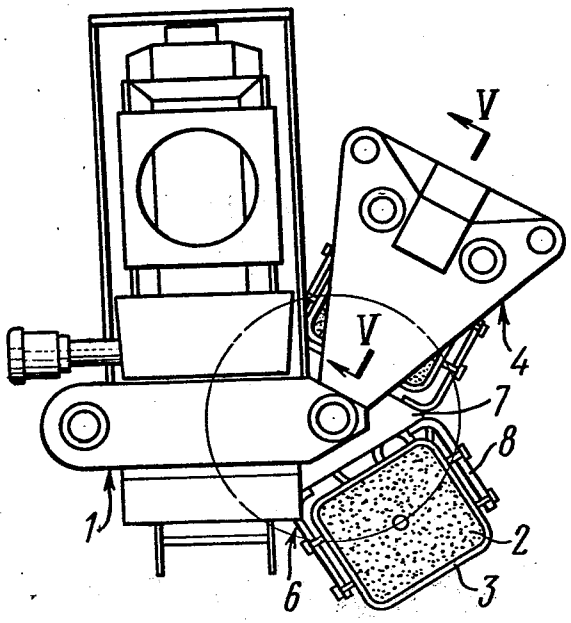
FIG. 1 is a top plan view of a flaskless stack molding machine, according to the invention.
Figure 6:
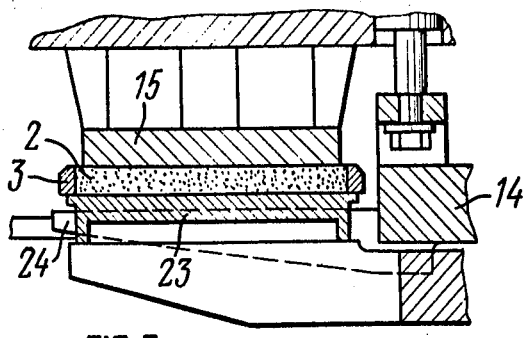
FIG. 6 is an enlarged, front, elevational view, partly in section, of the mutual positions of the bottom and the top carriages, the bottom plate, the flask and the pan when the initial mold bears against the bottom plate.
Figure 7:
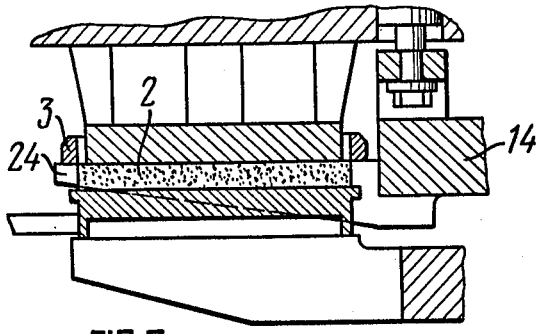
FIG. 7 is an enlarged, front, elevational view, partly in section, of the mutual positions of the bottom and the top carriages, the pan, the flask and the bottom plate when the top carriage terminates its upward motion after the flask is separated from the initial mold.
Figure 8:
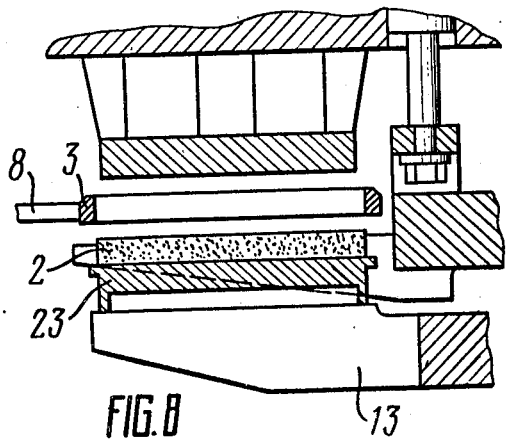
FIG. 8 is an enlarged, front, elevational view, partly in section, of the mutual positions of the bottom and the top carriages, the pan with the mold, the flask and the bottom plate when the top carriage ends its downward motion after an initial mold has been placed on the pan.

The operation of the machine is begun by making the mold 2 in the flask 3 of the means 1 (FIG. 1). Next, the means 6 transports the flask 3 with the mold 2 to the intermediate position and then to the means 4. The drive means 18 (FIG. 2) lifts the top carriage 14 together with the hydraulic cylinder 16, the resistance to the motion of the bottom carriage 13 producing a liquid pressure in the rod cavity of the hydraulic cylinder 16. Since this pressure is less than that which causes the liquid to flow through the pressure slide valve 20, said liquid fails to flow out of the rod cavity of the hydraulic cylinder 16 and, consequently, the bottom carriage 13 rises together with the top carriage 14. As the pan 23 moves upwards (FIG. 6), it contacts the mold 2 in the flask 3 and lifts the mold until it bears against the bottom plate 15. As the top carriage 14 rises, its planks 24 do not yet come into contact with the flask 3. While the top carriage 14 continues to rise, the bottom carriage 13, the pan 23 and the mold 2 remain stationary, but the pressure of the liquid in the rod cavity of the hydraulic cylinder 16 (FIG. 2) increases. This causes the pressure slide valve 20 to open, and the liquid passes through the slide valve 21 into the no-rod cavity of the hydraulic cylinder 16, thus allowing the top carriage 14 to move with respect to the stationary bottom carriage 13. During said motion, the planks 24 (FIG. 7) come into contact with the flask 3 and separate it from the fixed mold 2. When the carriage 14 ends its upward motion, the flask 3 has fully separated from the mold 2 and the top carriage 14 has moved with respect to the bottom carriage 13 by a value equal to the height of the mold 2. Next, the top carriage 14 is lowered to its original bottom position by the drive means 18 (FIG. 2), the flask 3, the hydraulic cylinder 16 and the bottom carriage 13 (FIG. 8) with the pan 23 and the mold 2 descending simultaneously. The flask 3 comes down upon the planks 8. The top plane of the mold 2 in its bottom position is level with the position the pan 23 occupied at the beginning of the operation, as is shown on FIG. 5.

Figure 9:
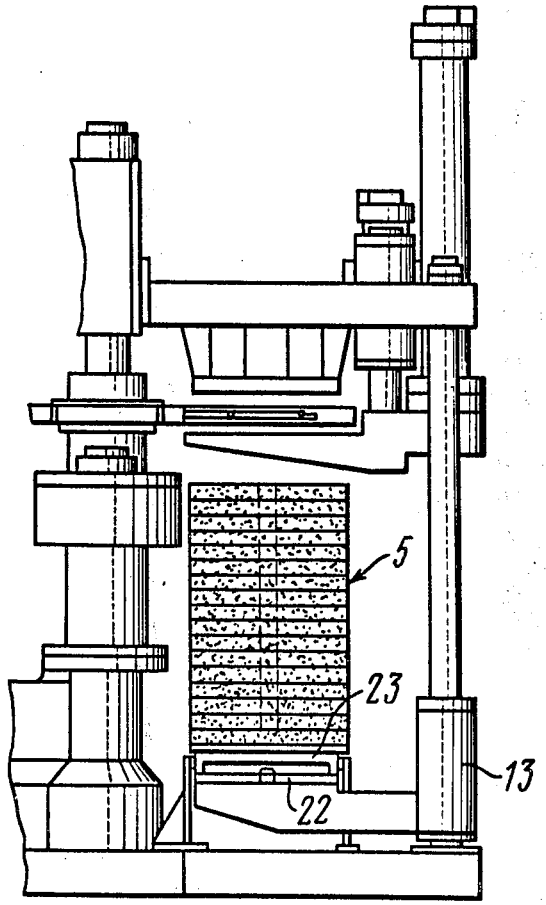
FIG. 9 is a side, elevational view of a flaskless stack molding machine after a stack has been assmebled.

The aforesaid motions are repeated during the manufacture of the subsequent molds 2 and their assembly into the stacks 5. After a stack 5 is completed (FIG. 9), molding is discontinued, and the bottom carriage 13 is lowered to the bottom position at which the pan 23 bears against the roller table 22. The pan 23 with the stack is removed from the machine and an empty pan 23 is placed in its stead.

In the proposed machine the discards of the castings are reduced by eliminating the misalignment of the molds 2 (FIG. 2) with respect to the other molds 2 in the stack 5 as the stack is being assembled. This advantage is obtained because each mold 2 is manufactured in the flask 3 and the mold 2 is placed in the stack 5 together with the flask 3. The stack 5 with the mold 2 is clamped between the pan 23 and the stationary bottom plate 15, the flask 3 then being separated from the mold 2. This sequence of motions is ensured by a single controllable-during-each-cycle drive means 18 and a single non-controllable hydraulic cylinder 16, thereby greatly simplifying the design of the machine and enhancing its reliability.

What is claimed is:

1. A flaskless stack molding machine comprising: a frame;

a manufacturing means for manufacturing molds in flasks located on said frame;

a separating and stacking means, for separating the flasks from the molds and stacking the molds, mounted on said frame, said separating and stacking means including a bottom carriage with means for supporting the molds, a bottom plate attached over said bottom carriage including flask-engaging means, and a top carriage for separating the flasks from the molds mounted between the bottom carriage and said bottom plate;

guides, on which said bottom carriage and said top carriage are mounted for vertical motion, attached to said frame;

an independent drive means for vertical movement of said bottom carriage rigidly connected to said top carriage;

a transporting means, for transporting the flasks freely placed thereon, secured to said frame; and an independent drive means for vertical movement of said top carriage secured to said frame.

2. A flaskless stack molding machine as claimed in claim 1 wherein the drive means for actuating the bottom carriage is a power hydraulic cylinder having a mobile link connected to said bottom carriage and a fixed link connected to said top carriage.

* * * * *